United States Patent [19]

Hernandez

[11] Patent Number: 4,531,180

[45] Date of Patent: Jul. 23, 1985

[54] INTERNAL SHIELD FOR TROUGH-LIKE REFLECTOR

[75] Inventor: Jose A. Hernandez, San Marcos, Tex.

[73] Assignee: Wide-Lite International, Inc., San Marcos, Tex.

[21] Appl. No.: 217,545

[22] Filed: Dec. 17, 1980

[51] Int. Cl.[3] ..... F21V 7/00

[52] U.S. Cl. ..... 362/297; 362/307; 362/310; 362/346; 362/349; 362/362

[58] Field of Search ..... 362/297, 307, 310, 346, 362/347, 348, 349, 350, 362, 217, 223, 225

[56] References Cited

U.S. PATENT DOCUMENTS

| | | | |
|---|---|---|---|
| 1,702,746 | 2/1929 | Prichard | 362/349 X |
| 3,413,462 | 11/1968 | Spero | 362/350 |
| 4,229,782 | 10/1980 | Ruud et al. | 362/348 X |
| 4,242,725 | 12/1980 | Douma et al. | 362/350 X |
| 4,261,030 | 4/1981 | Hernandez | 362/347 X |
| 4,293,901 | 10/1981 | Hernandez | 362/348 X |
| 4,310,876 | 1/1982 | Small, Jr. et al. | 362/346 X |

*Primary Examiner*—Peter A. Nelson

*Attorney, Agent, or Firm*—Vaden, Eickenroht, Thompson & Jamison

[57] ABSTRACT

A lighting fixture having a trough-type reflector and further having planar end reflectors, such fixture also including at least one planar shield parallel to the long axis of the trough-type reflector and having an edge parallel to the aiming axis of the fixture. The shield is undercut to permit light emanations from the lamp to be reflected from the entire trough-type reflector. The shield also includes depending points at the points of contact with the end reflectors, thereby preventing light from being reflected from the end reflectors outside of the shield.

6 Claims, 4 Drawing Figures

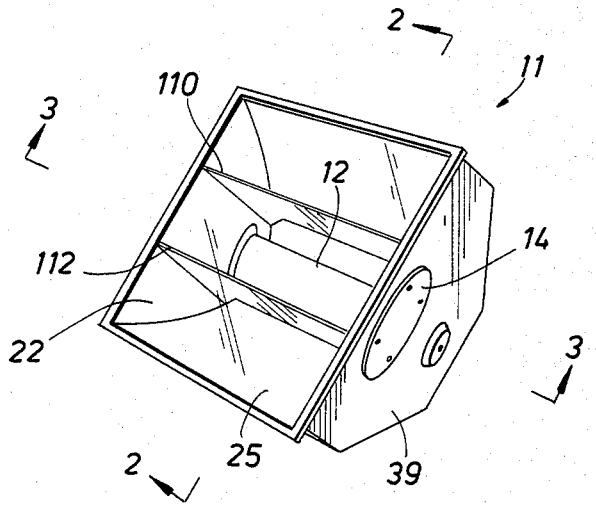
FIG. 1
FIG. 2
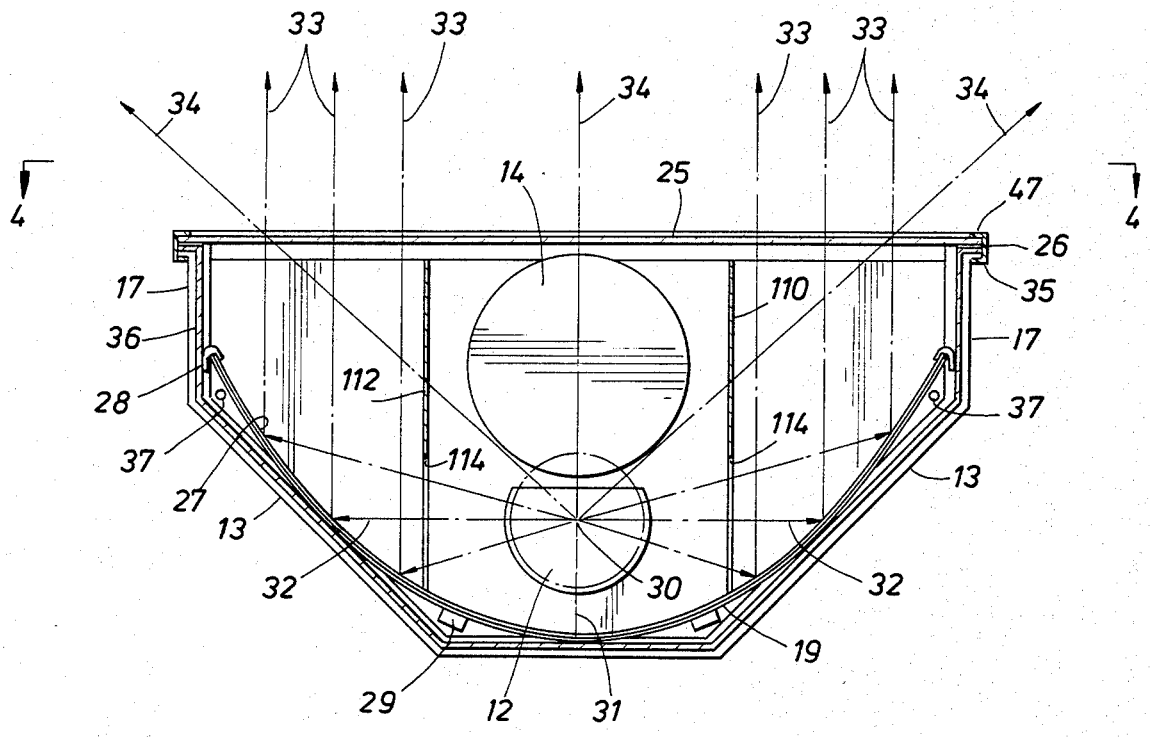

INTERNAL SHIELD FOR TROUGH-LIKE REFLECTOR

BACKGROUND OF THE INVENTION

1. Field of the Invention

This invention pertains to a lighting fixture and more particularly to an improvement in providing improved spill light characteristics to a lighting fixture with an elongated parabolic or similarly advantageously constructed reflector.

2. Description of the Prior Art

Light fixture housings and their light reflector systems used in conjunction with high intensity, gaseous discharge (HID) lamps are generally relatively complex structures. Reflectors used in such structures are preferably curvilinear so as to parabolically or otherwise advantageously reflect light from the fixture. Also, necessarily, such reflectors must accommodate to the elongated lamp structures which are used in the industry for HID lamps. Most HID lamps are elongated. Many fixtures include reflectors having multiple curved segments or segments which are complexedly curved with respect to one or more axes or focal points.

An example of a common type of reflector system is shown in patent application Ser. No. 21,269, now Pat. No. 4,261,030, entitled "Wraparound Parabolic Light Fixture and Method for Manufacture" filed Mar. 15, 1979, of the same inventor as the present application and commonly assigned, which application is incorporated herein by reference for all purposes. That reflector type is sometimes referred to as a trough reflector due to its appearance.

As explained in the above-identified patent application, there is an advantage to shaping the principal reflector to be in a parabolic shape because the emanating light from such a reflector is reflected in parallel fashion. It is often a requirement that such a light be used when wide area spill light from the fixture should be minimal. Spill light is a measure of focal efficiency of the overall reflector. Generally, spill light is that 10 percent of the light which is not within the 90 percent of the light emanating in the most focused direction. Light from such a fixture brightly illuminates the area directly in front of the fixture, or in other words, along the lines parallel to the principal reflection aiming axis.

Light also emanates from the ends of the lamp bulb, however, and without a reflecting surface would not result in additional light being reflected from the fixture. Therefore, to make the light fixture more efficient than otherwise, planar end reflectors are provided. Such reflectors are not made parabolic, however, primarily because it is expensive to make them of such shape for the incremental benefit that such a shape would make. These planar end reflectors reflect light in directions other than straightforward. These emanations do not just reflect outwardly from the ends of the lamp but also cross reflect and reflect at angles sideways to the fixture so that they, in part, do defeat the parabolic radiations from the principal reflector and result in wide area spill light.

Louvers and other light restrictions can be employed, but only at the expense of sharply decreasing light efficiency. This is also true of darkening selected reflecting surfaces compared with the specular treatment of other surfaces.

Therefore, it is a feature of the present invention to provide an improved trough-type parabolic light fixture in which the light reflections emanating from the end reflectors do not radiate at an appreciable angle to the straightforward direction.

It is another feature of the present invention to provide an improved light fixture having a cutoff element which does not appreciably interfere with its straightforward reflections, while largely preventing spurious sideways or spill light reflections.

SUMMARY OF THE INVENTION

A preferred embodiment of the invention includes, in a light fixture for accommodating an elongated lamp, an elongated parabolic reflector having a primary aiming axis and two planar end reflectors. A spill light shield parallel to the lamp axis is located in the fixture to one side of the lamp placement location. It is also positioned so as not to interfere with the parallel light emanations from the parabolic reflector surface. The shield is undercut to permit full usefulness of the parabolic reflector, but such shield is pointed on the ends to block spill light reflections from the end reflectors. Straight forward reflections from the end reflectors, of course, are not blocked. Such structure prevents spill light from being reflected from the end reflectors in that area on the non-lamp side of the shield.

A second spill light shield also may be positioned in a similar manner on the other side of the lamp and when thusly positioned, functions in the same way with respect to the other side of the fixture. In such structure, straight forward light is reflected from the end reflectors from that area between the shields and straight forward light is reflected from the entire parabolic reflector, both inside and outside of the shields.

BRIEF DESCRIPTION OF THE DRAWINGS

So that the manner in which the above recited features, advantages and objects of the invention, as well as others which will become apparent, are attained and can be understood in detail, more particular description of the invention briefly summarized above may be had by reference to the embodiment thereof illustrated in the appended drawings, which form a part of this specification. It is to be noted, however, that the appended drawings illustrate only a preferred embodiment of the invention and are not to be considered limiting of its scope, for the invention may admit to other equally effective embodiments.

In the Drawings:

FIG. 1 is a pictorial illustration of a preferred embodiment of the invention disclosed herein.

FIG. 2 is a cross-sectional view taken at line 2—2 of the embodiment of the invention illustrated in FIG. 1.

DESCRIPTION OF THE PREFERRED EMBODIMENT

Figure 3:
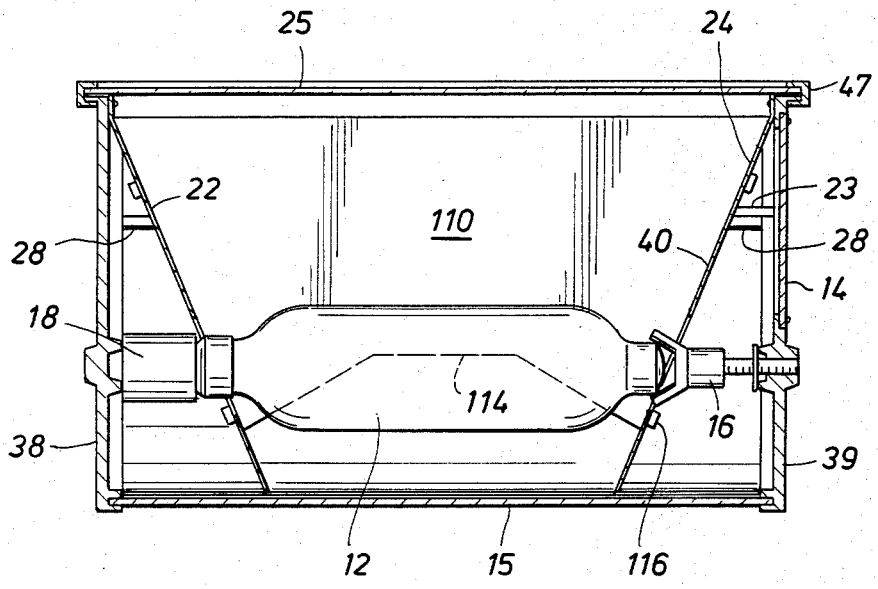
FIG. 3 is a longitudinal side view, in cutaway section, and taken along line 3—3 of the embodiment of the invention illustrated in FIG. 1.

Now referring to the drawings, and first to FIG. 1, an elongated light fixture in accordance with the present invention is illustrated. Elongated lamp 12 is longitudinally positioned to provide direct luminous flux emanating from its longest surface through a frontal opening in housing 11. Lamp 12 is preferably a highly efficient light source such as a high intensity gaseous discharge (HID) lamp. Indirect light reinforcing the intensity of the direct luminous flux is produced by a reflector system located behind lamp 12. Relamp door 14 provides access to lamp 12 for repair or exchange purposes.

Relamp door 14 is preferably weather tight when in the closed position and is preferably larger than the corresponding aperture in end wall 39 in which it is located and is conventionally secured therein by bolting. The sealing is accomplished via a washer (not shown) in conventional manner.

FIG. 2 is a cross-sectional view of the light fixture illustrated in FIG. 1. The inner side walls of the housing are comprised of two planar side walls 13 joined to a planar intermediate wall 15 and angled outwardly from such intermediate wall at complementary 45° angles. Such side and intermediate walls are conveniently and economically made from a continuous rectangular piece of sheet metal by bending such sheet metal in the desired shape. The outer or forward side walls are constructed from the same continuous rectangular piece of sheet metal by further bending the metal an additional 45°. Hence, the two forward sides 17 are at an angle of approximately 90° with respect to intermediate wall 15 providing greater frontal area, the benefit of which, aside from the aesthetics, will become apparent. Each bend in the sheet metal is parallel to the other bends and perpendicular to the longitudinal axis of the rectangle. The entire sheet provides a complete wraparound housing for containing the reflector system described below. Reflector sheet 27 is snapped into place within the housing so that it is tangential to side walls 13 and intermediate wall 15. Sheet 27 is held in place by a plurality of stop means in the form of clips or preferably elongated strips 28 located on forward sides 17. Elongated strips running the whole or partial length of forward sides 17 form stable supports, and are easier to manufacture and install than a plurality of clips.

A highly desirable form of illumination is direct light reinforced by primary indirect light parabolically reflected. A parabolic reflector is defined as a concave mirrored surface which is a paraboloid of revolution and produces parallel rays of light from the source located at the focus of the parabola. To reflect light parabolically, lamp 12 has a focal point 30 and is positioned so that a plane perpendicularly bisecting the intermediate side wall 15 also intersects such focal point. The width of the intermediate side wall 15 is determined such that with reflector sheets 27 attached to the housing, the length of imaginary perpendicular bisecting plane 31 from focal point 30 to intermediate wall 15 is one-fourth the distance of a second imaginary plane 32 perpendicular to plane 31 stretching between reflector 27 tangential at those points to side walls 13 and passing through focal point 30. The resulting curvature of reflector 27 between the three tangential points creates a parabolic reflector. The desired parabolic reflection characteristics of reflecting primary waves of light that are parallel to each other, can be substantially continued throughout the total length of reflector 27 by properly placing clips 28 on the forward walls, thereby decreasing the angle of curvature of the reflector with respect to the longitudinal axis of lamp 12.

Forward sides 17 are preferably also covered with reflector sheets 36 or otherwise treated to be reflective. Reflector sheets 36 and reflector sheet 27 may be constructed from specular, brushed, defused, hammertoned, or other conventional reflective material, or any combination thereof. Further, reflector sheet 27 is constructed of a material that is, to some degree, flexible, such as a sheet of thin metal, to permit curving when longitudinally or latitudinally slightly bent as a whole unit.

A closure lens 25 covers the frontal opening created by the housing and can be of any conventionally used material for lamp lenses such as glass or a multitude of different plastics. The lens is preferably securely affixed to the housing in a manner that precludes undesirable elements of weather from entering the housing and degrading the internal light fixture elements, such as conventionally bolting closure lens 25 to housing 11. A particularly convenient method of attaching plastic closure lens to the housing is described in U.S. Pat. No. 4,240,853, entitled "Lens Closure for Light Fixture and Method for Attachment", commonly assigned with the present application. The frontally facing ends of the side walls and end walls are bent, forming an outwardly projecting flange 35 on the frontal face of the housing. Closure lens 25 can then be united with the flange by a double-sided adhesive tape 26, with a metal cord trim 47 covering the securing and unified tape-and-lens structure, if desired.

Reflectors in close proximity to high intensity lamps undergo considerable stress due to constant extreme temperature changes. One or more thin, narrow cushion strips 19 are preferably clipped into place beside each other, behind and in the same manner as reflector 27, supporting reflector 27 and in retaining its shape should such reflector anneal. Cushion strips 19 may be constructed from sheets of aluminum alloy or other conventional metals that are produceable in thin strips and having a higher temper and more spring than reflector 27.

FIG. 3 is a longitudinal side view, in cutaway section, taken along section line 3—3 of the light fixture illustrated in FIG. 1. An electrical socket 18 is attached to end wall 38. Electrical socket 18 is preferably capable of slight upward tilting movement in the direction of closure lens 25, thereby facilitating reception of an elongated light source such as a standard size HID lamp 12. Most lamps of a given wattage and type are approximately a standard length in the United States. That is, a fixture designed to receive a 400-watt metal halide lamp can very certainly receive a replacement metal halide lamp without having to adjust either an end reflective sheet or the fixture components for holding the lamp. End reflector sheet 22 can be constructed from or covered with specular, brushed, defused, hammertoned, or other conventional reflective material and is preferably attachable to end wall 38 and parabolic reflector 27 illustrated in FIG. 2, reflects light through the window covered by closure lens 25. End reflector sheet 22 is preferably attached so as to make an angle of approximately 68° with the plane of intermediate wall 15, thereby providing efficient outward reflection of the light beam and focusing the light reflected by parabolic reflector 27. Further, end reflector 22 is preferably shaped so as to tangentially traverse parabolic reflector 27, thereby structurally supporting and maintaining the shape of such parabolic reflector.

Although other methods of connecting end reflector 22 to end wall 38 are well-known in the art, one convenient method is by bolting. A particularly convenient method of attaching end reflector 22 to parabolic reflector 27 illustrated in FIG. 2 is providing end reflector 22 with tabs and punching slots in parabolic reflector 27 to accommodate such tabs when inserted therein. End reflector 22 includes an aperture therein for access to lamp 12 so that it can be connected to or removed from electric socket 18. Light support 16 is adjustably attached, permitting longitudinal movement along longitudinal lamp axis 12, to end wall 39. Although various conventional light supports may be used, illustrated light support 16 preferably has desirable heat insulating and cushioning surfaces arranged in a generally conical pattern as is further described for a preferred embodiment thereof in U.S. Pat. No. 3,781,539. This permits use of the fixture with various wattage lamps or with lamps that are of foreign manufacture.

A second end reflector 24, is attached to end wall 39 in the same manner as end reflector 22 is attached to end wall 38. End reflector 24 is preferably attachable to parabolic reflector 27 by the same above-identified system of tabs and slots at approximately a 68° angle with the plane of intermediate wall 15. End reflector 24 also has a first aperture sufficiently large to accommodate either the non-electrical end portion of lamp 12 as it is joined with adjusted light support 16 or the end of light support 16 when extended to join with a smaller lamp. Relamp door 14 is attached via connecting bar 23 to removable portion 40 of end reflector 24. Thus, removal of relamp door 14 permits access to lamp 12.

It should also be noted that by using a series of reflectors tending in part to reinforce each other and whose reflective surfaces and reflecting capabilities can be varied, the beamed candle power distribution can be varied without actually changing the shape of the reflector.

FIG. 5 illustrates bolting rods 37 that run through the length of the housing between reflector 27 and the side walls of the housing and are attached to end wall 38 and to end wall 39, thereby securing such end walls to the side walls forming the housing. End wall 38 and end wall 39 preferably have peripheral grooves (not shown) to facilitate connection onto the ends of the walls formed in the wraparound sheet. Washers are preferably used in the grooves to assist in making the connection weather tight. An alternative method of attachment would be to spot weld the end walls to the side walls of the housing.

It may be observed that a reflector sheet of proper dimension clipped in place in a manner similar to parabolic reflector 27 herein described, could assume a parabolic shape even though it might not be tangential to some or all of the described side walls, intermediate wall, reflector sheets. Such a nonsupported reflector sheet would be subject to external pressures, especially heat and cold expansion forces, tending to warp the reflector. The support affected by end reflector sheets in the side and intermediate walls reinforce the parabolic reflector by acting in concert with the resilient pressures exerted by the cushion strips and improve the life and consistency of the parabolic reflector.

Now referring again to FIG. 1, shields 110 and 112 are shown which are positioned respectively on either side of lamp 12 and parallel with the elongated axis thereof. As may be best seen in FIG. 3, shield 110 fits into position between end walls 22 and 24 and includes an undercut 114 which permits light from lamp 12 to shine underneath shield 110 to be reflected on the other side of shield 110 in parabolic fashion from parabolic reflector 25, as previously described.

It is also apparent by looking at the side view of reflector 110 in FIG. 2 that the reflector is parallel to the light emanating in the direction of the aiming axis 34. It also may be observed, as explained above, that undercut 114 is sufficient to permit the light emanating directly from lamp 12 to pass through the undercut to be reflected forward from the parabolic reflector.

Shields 110 and 112 are secured in place by tabs 116 which fit through accommodating slots in reflectors 22 and 24, as shown in FIG. 3.

Figure 4:
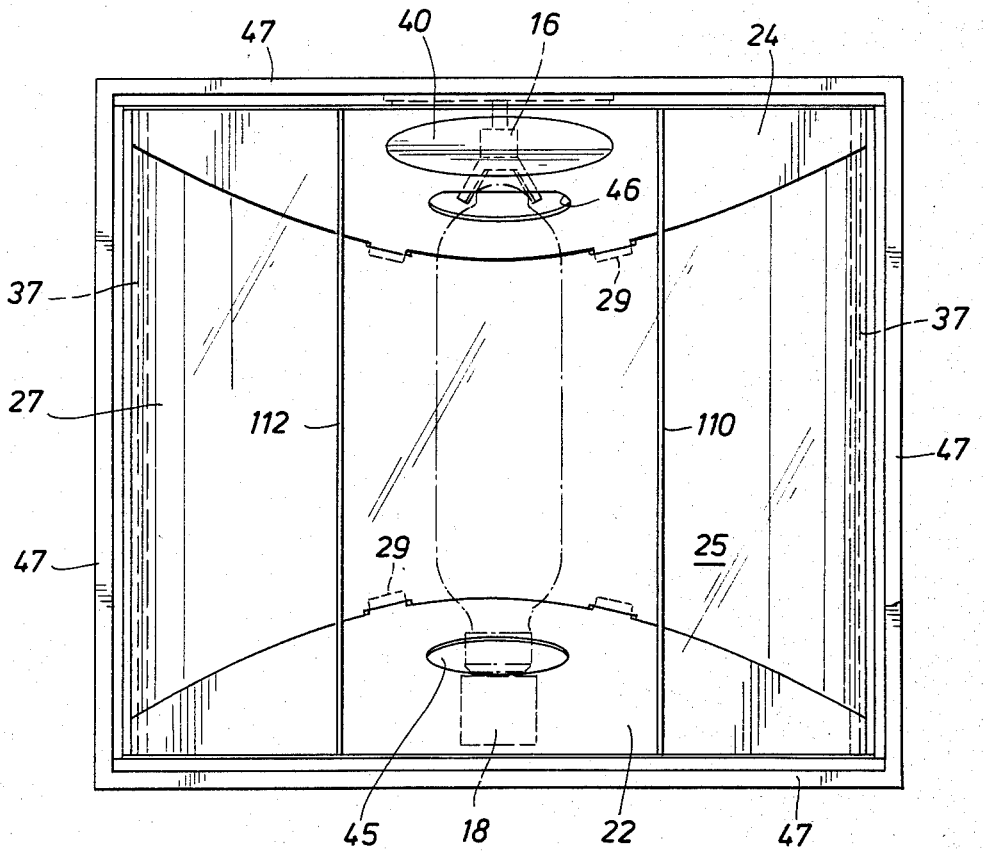
FIG. 4 is a frontal view taken at line 4—4 of the embodiment of the invention illustrated in FIG. 2.

Now referring to FIG. 4 and assuming for the moment the absence of shields 110 and 112, a person standing beneath the light fixture, but to one side thereof, would not see lamp 12 reflected in the parabolic reflector since the light emanations therefrom emanate in parallel fashion. However, lamp 12 would be seen reflected in end reflectors 22 and 24 since these reflectors are not parabolic. This means that there is undesirable light spread or spill light which would defeat, to some extent, the parallel parabolic-type emanations from reflector 25. With the presence of the points on shields 110 and 112, however, such sideways reflections of light from the end reflectors is eliminated without interfering with the forward reflections from both the parabolic reflector as well as the end reflectors between the shields. That is, lamp does not reflect from the end reflectors outside of the shield because of the depending points on the shields. Note that only the center portion of the shields are undercut for light passage purposes. Forward light from the entire parabolic reflector is unaffected by the shields and forward light from the end reflectors between the shields is not affected.

For increased efficiency, it is desirable to specularly finish the side of shields 110 and 112 which are on the lamp side of the shields. The outside of these shields, however, may be either darkened if it is desired to eliminate reflections therefrom altogether, or they also may be made specular, since only spurious light reflections will be reflected in their directions from the parabolic reflector located outside of the shields.

While particular embodiments of the invention have been shown and described, it will be understood that the invention is not limited thereto, since many modifications may be made and will be apparent to those skilled in the art. For example, it may be desirable to have a spill light shield 110 located on one side of the lamp, as previously described, without having a shield 112 on the opposite side, in some installations where light spread in one direction is acceptable or desired.

I claim:

1. A lighting fixture for mounting therein a lamp having an elongate axis, comprising a housing at least partially surrounding the elongate axis of the lamp so as to leave an opening on one side thereof for light emanations, a parabolic reflector positioned within said housing to cause parallel light emanations through said housing opening from primary light reflections, at least one end reflector cutting across the elongate lamp axis for radiating primary light reflections from the lamp through said opening, and a light spill shield parallel to the lamp axis and to one side thereof having a cross-section parallel to the parabolic reflector emanations, said shield including an undercut opening for permitting primary light reflections from the lamp over substantially the entire parabolic reflector on the other side of said shield from the lamp, said shield having a depending portion for shielding against primary reflections emanating through the opening from that portion of said end reflector on the other side of said shield from the lamp.

2. A lighting fixture in accordance with claim 1, wherein said end reflector joins said parabolic reflector in a curvilinear line substantially perpendicular to the lamp axis.

3. A lighting fixture in accordance with claim 1, and including a second end reflector located at the opposite end of the lamp from said first-named end reflector, said second end reflector cutting across the elongate lamp axis for radiating primary light reflections from the lamp through said housing opening.

4. A lighting fixture in accordance with claim 3, wherein said shield has a second depending portion for shielding against primary reflections emanating through the housing opening from that portion of said second end reflector on the other side of said shield from the lamp.

5. A lighting fixture in accordance with claim 1, and including a second spill light shield parallel to the lamp axis and to the other side thereof from the position of said first-named spill light shield, said second shield having a cross-section parallel to the parabolic reflector emanations, said second shield including an undercut opening for permitting primary light reflections from the lamp over substantially the entire parabolic reflector on the other side of said second shield from the lamp, said second shield having a depending portion for shielding against primary reflections emanating through the housing opening from that portion of said end reflector on the other side of said shield from the lamp.

6. A lighting fixture in accordance with claim 1, and including a second end reflector located at the opposite end of the lamp from said first-named end reflector, said second end reflector cutting across the elongate lamp axis for radiating primary light reflections from the lamp through said housing opening, said first-named spill light shield having a second depending portion for shielding against primary reflections emanating through the housing opening from that portion of said second end reflector on the other side of said shield from the lamp, and a second spill light shield parallel to the lamp axis and to the other side thereof from the position of said first-named spill light shield, said second shield having a cross-section parallel to the parabolic reflector emanations, said second shield including an undercut opening for permitting primary light reflections from the lamp over substantially the entire parabolic reflector on the other side of said second shield from the lamp, said second shield having a first depending portion for shielding against primary reflections emanating through the housing opening from that portion of said first-named end reflector on the other side of said second shield from the lamp, said second shield having a second depending portion for shielding against primary reflections emanating through the housing opening from that portion of said second end reflector on the other side of said second shield from the lamp.

* * * * *